US005158367A

United States Patent [19]

Derby

[11] Patent Number: 5,158,367

[45] Date of Patent: Oct. 27, 1992

[54] SPREAD STRAP FLEXIBLE BULK CONTAINER

[75] Inventor: Norwin C. Derby, Sherman, Tex.

[73] Assignee: Super Sack Manufacturing Corporation, Dallas, Tex.

[21] Appl. No.: 731,663

[22] Filed: Jul. 17, 1991

Related U.S. Application Data

[63] Continuation-in-part of Ser. No. 616,217, Nov. 20, 1990, Pat. No. 5,076,710.

[51] Int. Cl.[5] ..... B65D 30/10; B65D 33/14

[52] U.S. Cl. ..... 383/17; 383/22; 383/105; 383/107; 383/907

[58] Field of Search ..... 383/6, 17, 22, 105, 383/107, 907

[56] References Cited

U.S. PATENT DOCUMENTS

| | | | |
|---|---|---|---|
| 616,249 | 12/1898 | Nickerson . | |
| 1,148,948 | 8/1915 | Benjamin . | |
| 1,174,552 | 3/1916 | Dubois et al. . | |
| 1,335,607 | 3/1920 | Salisbury | 383/107 |
| 1,525,594 | 2/1925 | Sesser . | |
| 1,677,583 | 7/1928 | Cromwell . | |
| 2,041,515 | 5/1936 | Richards . | |
| 2,047,095 | 7/1936 | Booth . | |
| 2,740,445 | 4/1956 | Fornell | 383/22 |
| 2,808,091 | 10/1957 | Cumbler | 383/107 |
| 3,011,682 | 12/1961 | Kus . | |
| 3,374,929 | 3/1968 | Silfverskiold . | |
| 3,523,637 | 8/1970 | Stec . | |
| 3,789,897 | 2/1974 | Saito . | |
| 3,827,471 | 8/1974 | Gregory et al. . | |
| 3,893,595 | 7/1975 | Khanna et al. . | |
| 3,949,901 | 4/1976 | Tokita . | |
| 3,961,655 | 6/1976 | Nattrass et al. . | |
| 3,973,609 | 8/1976 | Lofberg . | |
| 4,113,146 | 9/1978 | Williamson . | |
| 4,224,970 | 9/1980 | Williamson et al. | 383/17 |
| 4,300,608 | 11/1981 | Cuthbertson | 383/22 |
| 4,356,853 | 11/1982 | Sekiguchi | 383/107 |
| 4,390,051 | 6/1983 | Cuthbertson . | |
| 4,479,243 | 10/1984 | Derby et al. . | |
| 4,480,766 | 11/1984 | Platt | 383/17 |
| 4,493,109 | 1/1985 | Nattrass . | |
| 4,597,102 | 6/1986 | Nattrass | 383/105 |
| 4,646,357 | 2/1987 | Nattrass . | |
| 4,822,179 | 4/1989 | Nattrass . | |

FOREIGN PATENT DOCUMENTS

| | | | |
|---|---|---|---|
| 85215 | 5/1965 | France | 383/105 |
| 339825 | 12/1930 | United Kingdom . | |
| 1097040 | 12/1967 | United Kingdom . | |
| 1340693 | 12/1973 | United Kingdom . | |
| 1590943 | 6/1981 | United Kingdom . | |

*Primary Examiner*—Stephen P. Garbe
*Attorney, Agent, or Firm*—Michael A. O'Neil

[57] ABSTRACT

A spread strap flexible bulk container comprises a flexible bulk container having a plurality of panels seamed together to form a substantially cylindrical container with vertical seams connecting the panels. Lift straps for supporting the container are attached at opposed ends to the container beginning adjacent the seams and extending diagonally upwardly to loop over the top panel of the container.

8 Claims, 4 Drawing Sheets

SPREAD STRAP FLEXIBLE BULK CONTAINER

CROSS REFERENCE TO RELATED APPLICATION

This application is a continuation-in-part application of application Ser. No. 07/616,217, filed Nov. 20, 1990 now U.S. Pat. No. 5,076,710.

TECHNICAL FIELD

This invention relates generally to flexible bulk containers for receiving, transporting, and storing flowable materials, and more particularly, to flexible bulk containers having lift straps excluding diagonally over the container from adjacent construction seams for a more even distribution of the load.

BACKGROUND AND SUMMARY OF THE INVENTION

Historically, flexible bulk containers have been used for receiving, storing, transporting and discharging flowable materials of all types. The containers are typically constructed in a square or vertically rectangular shape with lift straps attached to each of the uppermost corners of the square or rectangle.

Four panels are stitched together to form a perimeter wall which is in turn stitched to upper and lower panels to form the enclosed container. The panels used to form the perimeter wall are stitched together such that the seams connecting the panels are located in the corners of the container. The lift straps are typically stitched or otherwise attached to the uppermost corners of the container and adjacent to the seams connecting the panels to form the perimeter wall. Thus, through placement of the panel seams and the lift straps on the four corners, when filled, a substantial load is placed on the corners, thereby stressing the seam and threatening the integrity of the container.

In some instances, the ends of the lift straps are attached to the side panels at points away from the corner seams and extend up and over the corners of the top panel to form a loop. To reinforce the lift straps attached in such manner, a band of reinforced material extends vertically down the side of the container at the location of attachment of the ends of the lift straps. Thus, when the container is filled, lifting of the straps diverts some of the load stress away from the seamed corners, but concentrates more of the load on the spread apart ends of the lift straps.

The present invention overcomes the foregoing and other problems heretofore experienced in construction and use of flexible bulk containers. With reference to a first embodiment of the invention, four side panels are seamed together to form a perimeter wall which is in turn attached to a round bottom panel and, in some cases, a top round panel. Lift straps are attached to the perimeter wall of the container with the opposed ends of the straps being attached along lines beginning at adjacent seams connecting the panels and extending diagonally upwardly and away from the seams to points adjacent the attachment of the perimeter wall to the top panel. A center portion of each strap extends upwardly from the attachment points and diagonally over the top panel to form a loop above the container. Thus, the straps are attached to the container along the sides as opposed to corners of the container. Each strap is attached to its individual associated panel prior to seaming the panels to one another to simplify construction of the container. By using round bottom and or top panels to form a round container and attaching the straps to extend from the seams and loop over the containers, the load is more evenly distributed over the entire container with the added strength of a continuous piece of the container material extending around what in prior art containers would be the corner.

In a second embodiment of the invention, two side panels are attached along the bottom and both side edges to a single long panel forming the perimeter and bottom walls of a container. A round top panel is then attached to the upper edge of the perimeter wall. Thus, the construction of the top portion of the container is the same as the construction of the top portion of the first embodiment. Substitution of the single long panel for the bottom and two side panels of the container results in the container having a circular top and square or rectangular bottom. The lift straps may be attached in the same manner as in the first embodiment of the invention. As with the first embodiment, the use of a round top panel and attachment of the lift straps to extend from adjacent panel seams over the top of the container results in more even distribution of the load throughout the container, thereby reducing the threat of failure of a filled container.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION OF THE INVENTION

Figure 1:
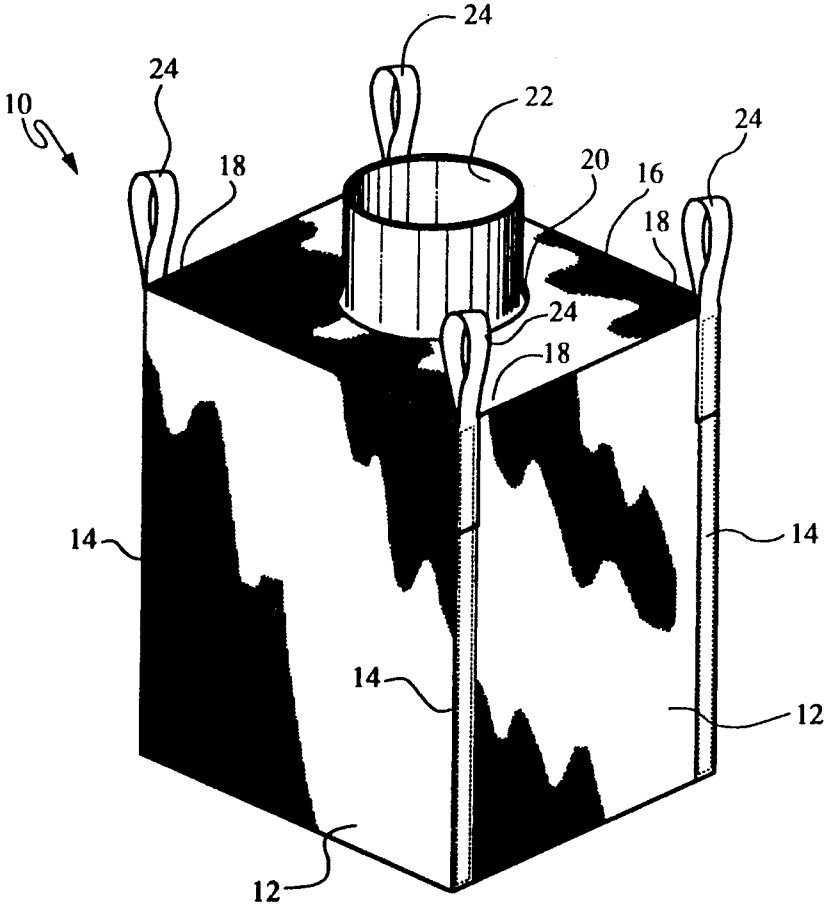
Fig.1 (PRIOR ART)
FIG. 1 is a front view of a prior art flexible bulk container with corner seams and corner lift straps.

Referring now to the Drawings more more particularly to FIG. 1 thereof, there is shown a prior art flexible bulk container 10 comprising four side panels 12, seamed together along corner seams 14. A top panel 16 is attached to the upper edges of the panels 12 such that the corners 18 of the top panel 16 are attached at the seams 14.

An opening 20 is placed in the center of the top panel 16, through which a fill spout 22 extends for filling the container. Lift straps 24 are attached to the panels 12 along the seams 14, for lifting the container 10. A bottom panel (not shown) is attached along the bottom edges of the side panels 12 such that the corners of the bottom panel are attached to the seams 14. The construction of the container 10 is such that, when filled, a substantial portion of the load is concentrated at the seams 14 and along the lift straps 24, thereby threatening the integrity of the filled container 10.

Figure 2:
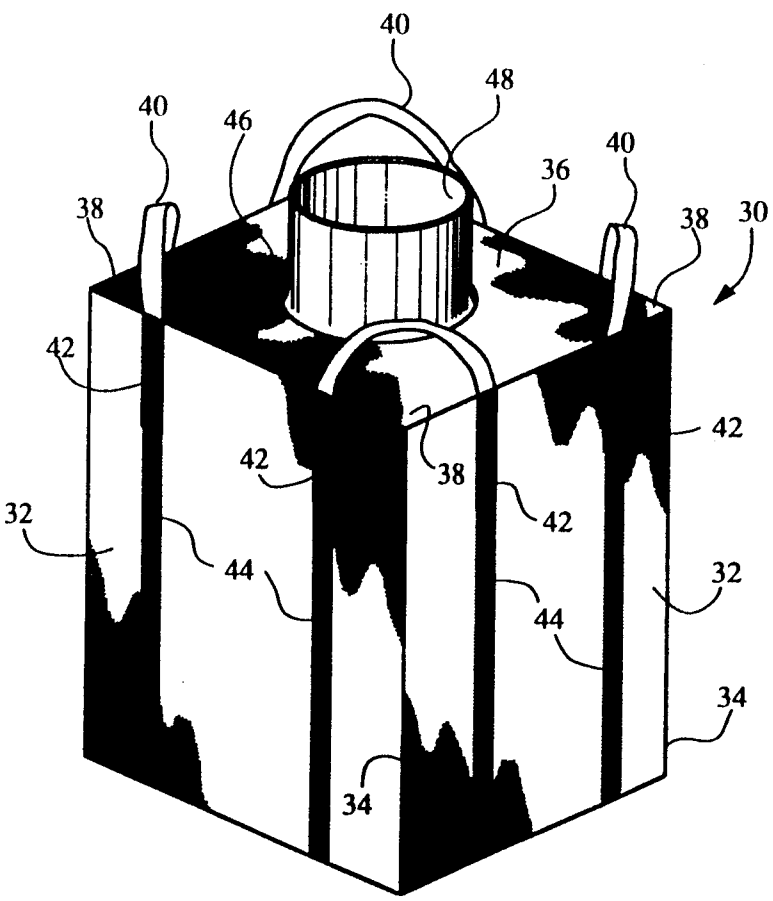
Fig.2 (PRIOR ART)
FIG. 2 is a front view of a prior art flexible bulk container with corner seams and lift straps attached at points away from the corners.

Referring now to FIG. 2, there is shown a second prior art container 30 having four side panels 32 connected at seams 34. A top panel 36 is attached to the upper edges of the side panels 32 such that the corners 38 of the top panel 36 are attached to the seams 34. A bottom panel (not shown) is attached to the lower edges of the panel 32 in the same manner as is the top panel 36.

Lift straps 40 having two opposed ends 42 are attached to the panels 32 at locations spaced away from the seams 34 such that each opposed end 42 of the lift strap 40 is attached to a panel 32 adjacent to the panel 32 to which the remaining end 42 of the lift strap is attached. To reenforce the attachment point of the lift straps 40 to the panels 32, a band of reenforced material 44 extends vertically the height of the panels 32 at the location of the attachment points of the lift straps to the panels 32. Alternatively, the reenforcing strip may be a length of webbing sewn to the panel.

To allow for filling of the container, there is an opening 46 located in the center of the top panel 36 through which a discharge spout 48 may extend. As with the prior art container 10, when the prior art container 30 is filled, a substantial portion of the load is asserted against the seams 34 located at the corners of the container 30 and along the attachment points of the lift straps 40 increasing the possibility of failure of the seams 34 and the straps 40 during lifting of a filled container.

Figure 3:
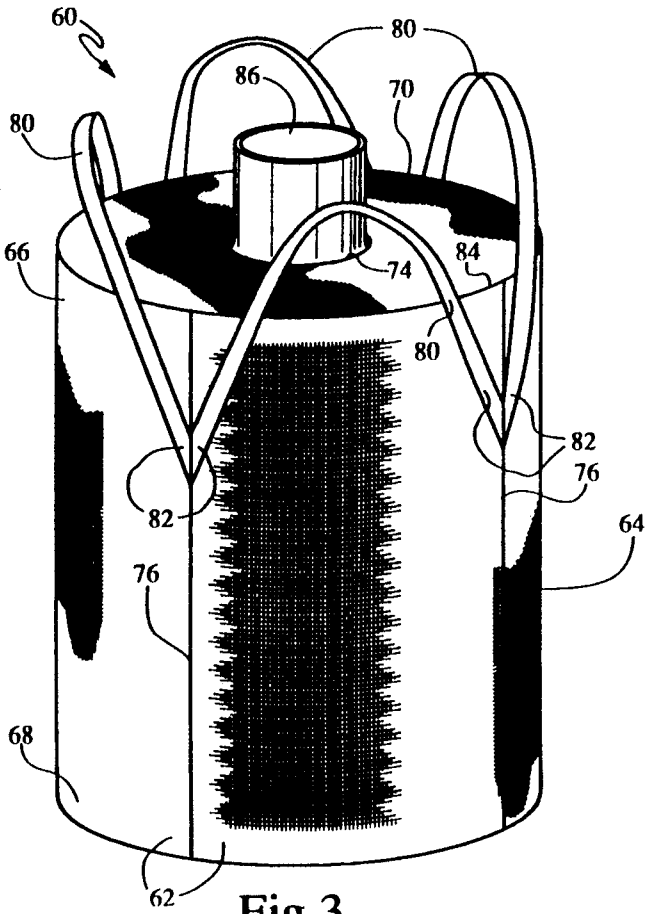
FIG. 3 is a front view of a flexible bulk container incorporating a first embodiment of the present invention.

A flexible bulk container 60 incorporating a first embodiment of the present invention as shown in FIG. 3, overcomes the foregoing problems by more evenly distributing the load stress throughout the container and away from the seams of the container. Side panels 62 are seamed together vertically to form a perimeter wall 64 having a first end 66 and a second end 68. Attached to the first end 66 of the perimeter wall 64 is a circular top panel 70 having a fill opening 74 located in the center of the top panel 70. The top panel 70 is attached to the first end 66 of the perimeter wall 64 to form a tubular shaped container. Thus, the seams 76 connecting the panels 62 are located in a circular perimeter wall and not at corners as in the prior art containers.

A bottom panel (not shown) is attached to the second end 68 of the perimeter wall 64 in the same manner as the top panel 70 is attached to the first end 66 of the perimeter wall 64. The bottom panel (not shown) may have an opening in the center of the bottom panel similar to the fill opening 74 in the top panel 70, which opening in the bottom panel may be used for discharging flowable materials from the container 60.

Lift straps 80 having opposed ends 82 are attached to the perimeter wall 64 of the container 60 for lifting and transporting the container 60. Each of the opposed ends 82 of the lift strap 80 are attached to the perimeter wall 64 beginning at a predetermined point along adjacent seams 76 and extending for attachment diagonally upwardly and away from the seams 76 to a seam 84 connecting the top panel 70 to the first end 66 of the perimeter wall 64. A center portion of the lift strap 80 extends above the seam 84 to form a loop extending diagonally over the top panel 70. Each lift strap 80 is attached to its individual associated side panel 62 prior to attachment of the side panels 62 to one another to form the perimeter wall 64, to thereby simplify construction of the container 60.

Figure 4:
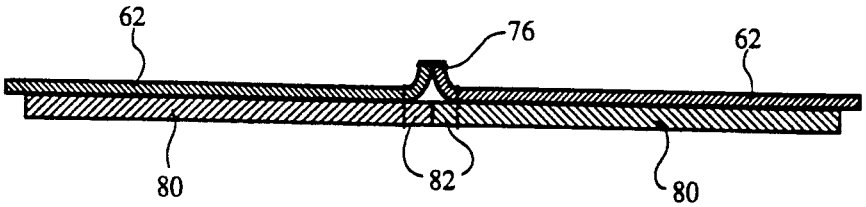
FIG. 4 is a sectional view showing attachment of one end of two adjacent lift straps to adjacent side panels of the container of FIG. 3.
Figure 5:
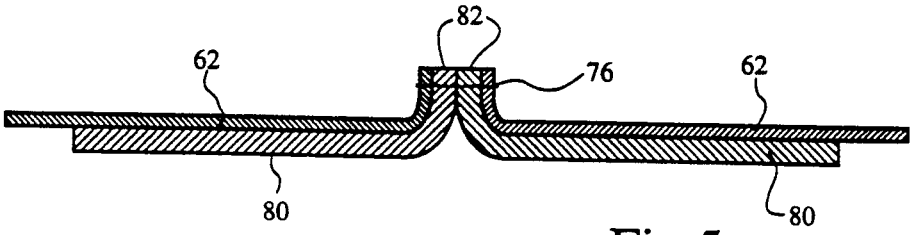
FIG. 5 is a sectional view illustrating attachment of one end of two adjacent lift straps to the container of FIG. 3 with the ends of the lift straps secured in the seam connecting two adjacent panels.
Figure 6:
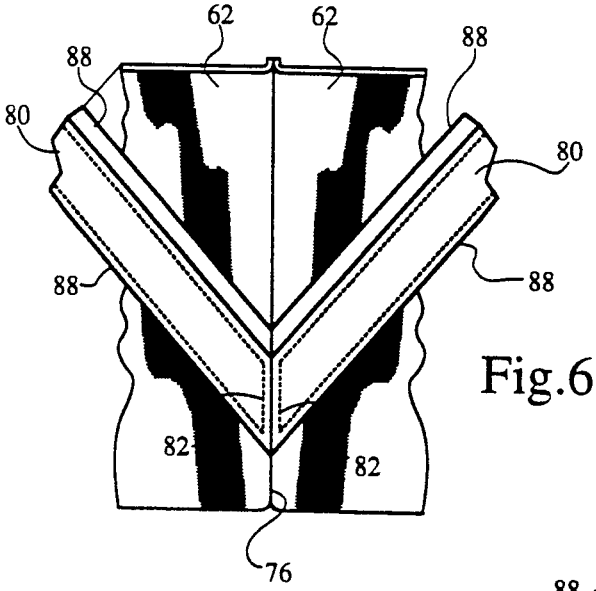
FIG. 6 is a partial front view illustrating attachment of two adjacent lift straps to the exterior of the container of FIG. 3.
Figure 7:
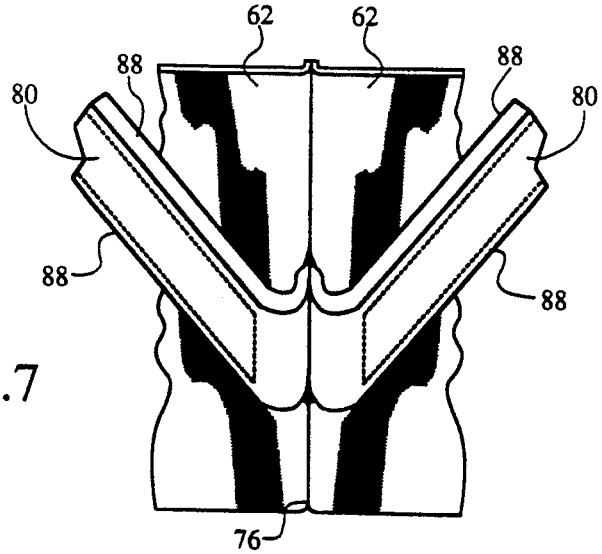
FIG. 7 is a partial front view illustrating attachment of two adjacent lift straps to the container of FIG. 3 wherein the ends of the lift straps are secured in the seam connecting adjacent side panel.

The ends 82 of the lift straps 80 may be secured within the seams 76, as illustrated in FIGS. 5 and 7, or may abut the end 82 of the next adjacent lift strap 80 on the exterior of the perimeter wall 64 at the seams 76, as shown in FIGS. 4 and 6. The lift straps 80 may be attached to the perimeter wall 64 by stitching along the opposed ends 82 and along opposed side edges 88 of the lift straps 80 to the point where the first end 66 of the perimeter wall 64 is attached to the top panel 70 and stitching diagonally across the lift straps 80 parallel to the seam 84 connecting the top panel 70 to the first end 66 of the perimeter wall 64 as shown in FIGS. 3 and 6. In the event the opposed ends 82 of adjacent lift straps 80 are secured within the seams 76, as shown in FIG. 7, the lift straps 80 may be attached to the perimeter wall 64 by stitching diagonally across the lift straps 80 immediately adjacent to the seams 76 and continuing diagonally upwardly therefrom along opposed side edges 88 of the lift straps 80 to the point where the first end 66 of the perimeter wall 64 is attached to the top panel 70 and stitching diagonally across the lift straps 80 parallel to the seam 84 connecting the top panel 70 to the first end 66 of the perimeter wall 64 as shown in FIG. 7.

As shown in FIG. 3, a fill spout 86 may extend through the opening 74 in the top panel 70 to allow filling of the container 60 with flowable materials. When the container 60 is filled, the use of circular bottom and/or circular top panels to remove all corners and the location of the lift straps 80 to extend diagonally from the seams 76 to form a loop above the top panel 70 results in better distribution of the load stress throughout the container, thereby reducing the possibility of failure along the seams 76 and the lift straps 80. Thus, when filled the container 60 assumes a cylindrical shape evenly distributing the load stress throughout the container 60.

Figure 8:
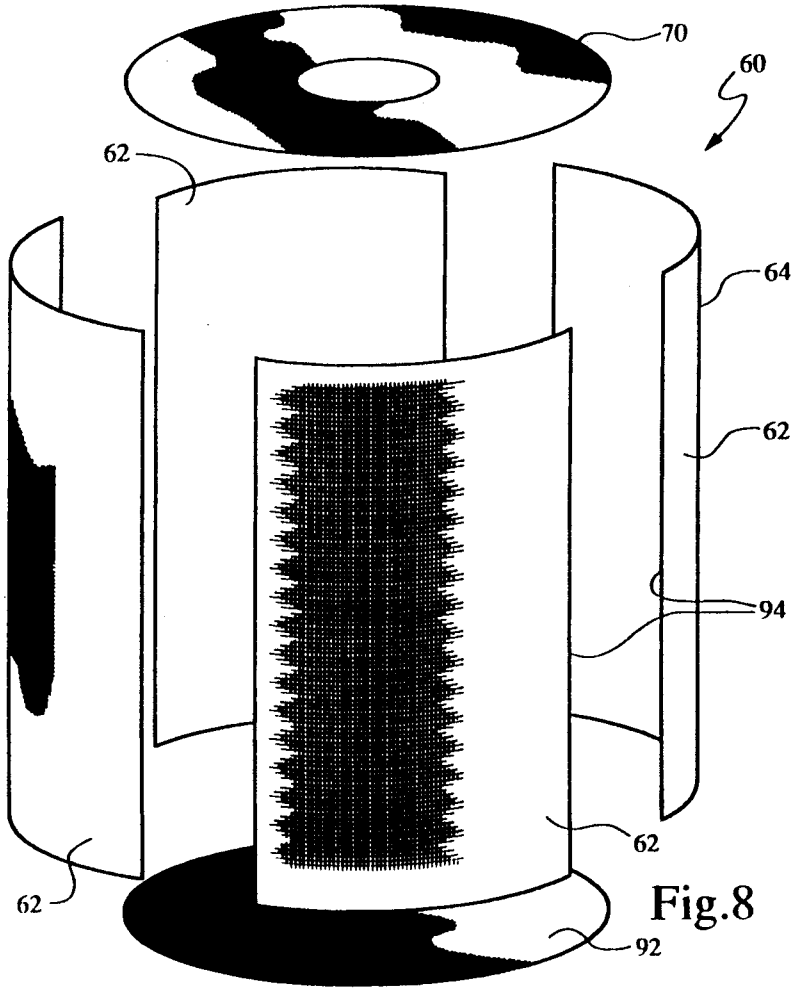
FIG. 8 is an exploded front view of the container of FIG. 3.

Referring now to FIG. 8, there is shown an exploded front view of the container 60 illustrating the positioning of the top panel 70 and a bottom panel 92 in relation to the side panels 62 and the seams 76 connecting opposed side edges 94 of the side panel 62 to form the perimeter wall 64.

Figure 10:
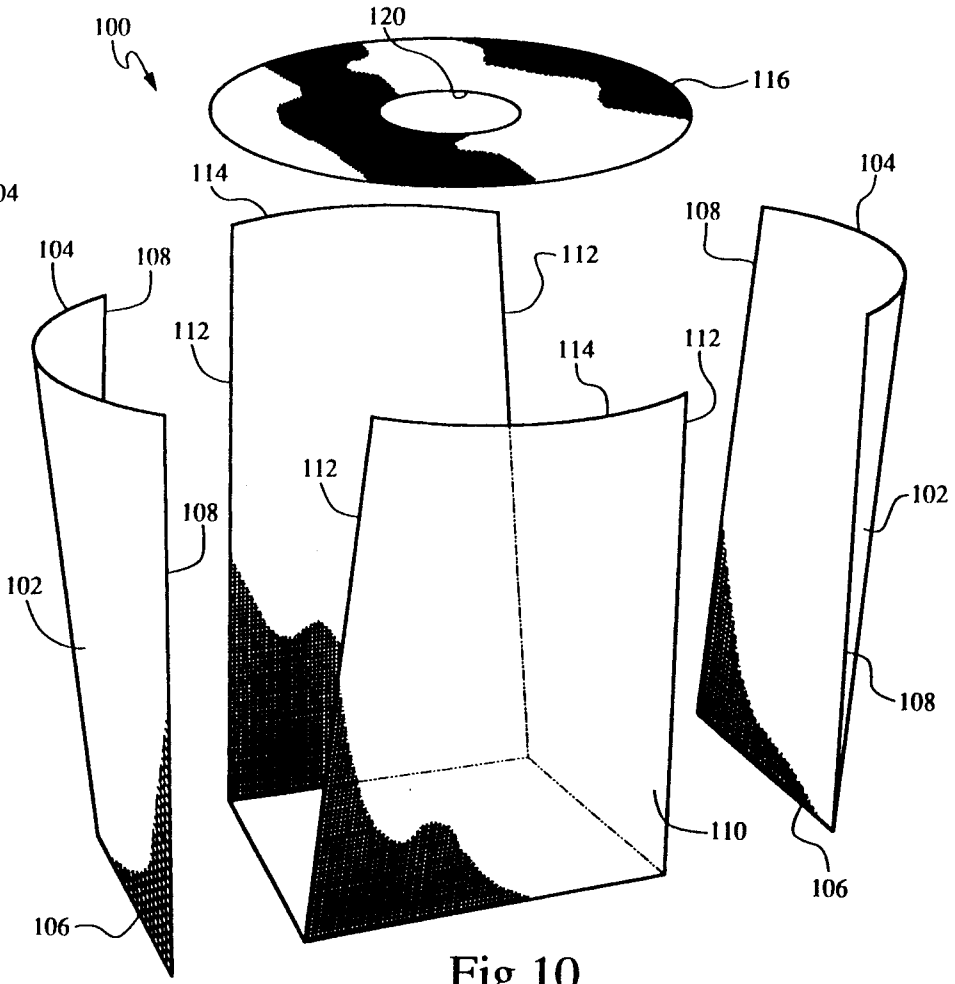
FIG. 10 is an exploded front view of the container of FIG. 9.
Figure 9:
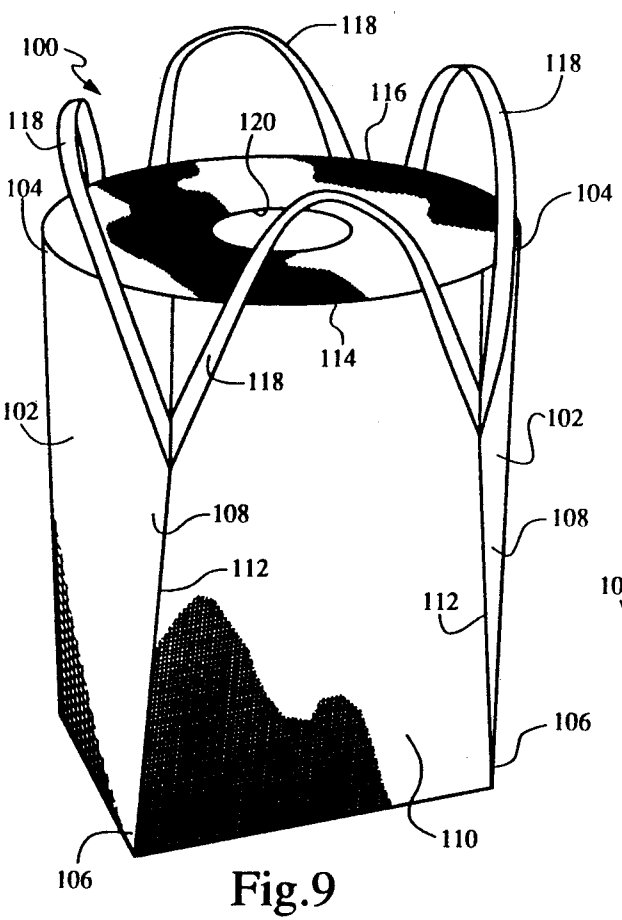
FIG. 9 is a front view of a flexible bulk container incorporating a second embodiment of the present invention.

A container 100 incorporating a second embodiment of the present invention is shown in FIGS. 9 and 10. Two side panels 102, each having a top 104, a bottom 106 and two side edges 108 are attached to an elongate panel 110 having opposed elongate side edges 112 and opposed shorter end edges 114. The elongate side edges 112 are equal in length to the combined length of the bottom edge 106 and the two side edges 108 of a side panel 102. The side panels 102 are seamed to the elongate panel 110 along the elongate side edges 112 of the elongate panel 110 and along the side edges 108 and the bottom edge 106 of each of the side panels 102 to form the perimeter and bottom walls of the container 100.

A circular top panel 116 is attached to the top edges 104 of the side panels 102 and the opposed shorter end edges 114 of the elongate panel 110 such that the container 100 assumes a circular top shape and square or rectangular bottom shape. Thus, the top panel 116 is attached to the side panels 102 and elongate panel 110 in the same manner in which the top panel 70 is attached to the first end 66 of the perimeter wall 64 of container 60 shown in FIGS. 3 and 8. Likewise, lift straps may be attached to the container 100 in the same manner in which the lift straps 18 are attached to the container 60 as illustrated in FIGS. 3 through 7. As with container 60, a fill opening 120 is placed in the center of the top panel 116 to allow for the receiving and discharging of flowable materials from the container 100. Likewise, a separate discharge opening (not shown) may be placed in the center of the elongate panel 110 midway between the opposed elongate sides 112 and midway between the opposed shorter end edges 114 to discharge flowable materials from the container 100.

As with the container 60, the use of a circular top panel 116 in connecting the side panels 102 and the elongate panel 110, to form a round top and square bottom container as well as the positioning of the lift straps 118 to extend diagonally from the seams connecting the panels 102 and 110 to loop diagonally above the top panel 116, result in more even distribution of load stress throughout the container 100 when filled. Furthermore, the use of a single elongate panel 110 instead of using four side panels and a separate bottom panel results in additional container strength. Such construction, thereby reduces the possibility of failure of the container 100 along seam lines as well as along the attachment points of the lift straps to the container 100.

Containers 60 and 100 are constructed in a more simplified manner than prior art containers. In the construction of containers 60, each of the lift straps 80 is attached to its associated side panel 62. Thereafter, the side panels 62 are attached to one another to form the perimeter wall 64 of the container. Subsequently, the top panel 70 is attached along its perimeter to the first end 66 of the perimeter wall 64. Next, the bottom panel 92 is attached along its perimeter to the second end 68 of the perimeter wall 64.

As with container 60, when constructing container 100 each lift strap 118 is first attached to its associated panel 102 or 110, with one lift strap being attached to each of the side panels 102 and two lift straps being attached to the elongate panel 110, one at each end thereof. Next, the side panels 102 are attached to the elongate panel 110 along the elongate side edges 112 of the elongate panel 110 and along the side edges 108 and the bottom edge 106 of each of the side panels 102. Finally, the top panel 116 is attached along its perimeter to the perimeter wall of the container 100 along the top edges 104 of the side panels 102 and the opposed shorter end edges 114 of the elongate panel 110.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the spirit of the invention.

I claim:

1. A flexible container for receiving, transporting, and storing flowable materials comprising:

four side panels seamed together to form a perimeter wall having first and second ends;

at least one circular end wall seamed to one end of the perimeter wall to form a cylindrical shaped container; and at least one strap having two opposed ends attached to a side panel with each of the opposed ends attached at adjacent seams connecting adjacent side panels and extending diagonally upwardly across the panel with a center portion of the strap extending above one end of the perimeter wall to form a loop.

2. The container of claim 1, further comprising a second circular end wall seamed to the remaining end of the perimeter wall.

3. The container of claim 1, further comprising an opening located in the center of at least one end wall for receiving and discharging flowable materials.

4. The container of claim 1, wherein the ends of the lift strap are secured within the seams connecting adjacent panels of the perimeter wall.

5. A flexible container for receiving, transporting, and storing flowable materials comprising:

a plurality of side panels seamed together to form a perimeter wall having first and second ends;

at least one circular end wall seamed to one end of the perimeter wall to form a cylindrical shaped container; and at least one strap having two opposed ends attached to a side panel with each of the opposed ends attached at adjacent seams connecting adjacent side panels and extending diagonally upwardly across the panel with a center portion of the strap extending above one end of the perimeter wall to form a loop.

6. The container of claim 5, further comprising a second circular end wall seamed to the remaining end of the perimeter wall.

7. The container of claim 5, further comprising an opening located in the center of at least one end wall for receiving and discharging flowable materials.

8. The container of claim 5, wherein the ends of the lift strap are secured within the seams connecting adjacent panels of the perimeter wall.

* * * * *